United States Patent [19]

Kasanami et al.

[11] Patent Number: 4,706,632

[45] Date of Patent: Nov. 17, 1987

[54] FUEL CONTROL APPARATUS FOR INTERNAL COMBUSTION ENGINE

[75] Inventors: Mitsuru Kasanami; Hideyuki Tamura, both of Yokohama, Japan

[73] Assignee: Nissan Motor Company, Limited, Japan

[21] Appl. No.: 925,151

[22] Filed: Oct. 27, 1986

[30] Foreign Application Priority Data

Oct. 28, 1985 [JP] Japan ..... 60-239563

[51] Int. Cl.[4] ..... F02D 41/10

[52] U.S. Cl. ..... 123/492; 123/480

[58] Field of Search ..... 123/478, 480, 492, 493, 123/494; 364/431.07

[56] References Cited

U.S. PATENT DOCUMENTS 4,266,522 5/1981 Williams et al. ..... 123/492
4,375,210 3/1983 Ohara et al. ..... 123/492 X
4,463,730 8/1984 Kishi ..... 123/492 X
4,469,073 9/1984 Kobayashi et al. ..... 123/492
4,490,792 12/1984 Deutsch et al. ..... 123/492 X
4,528,964 7/1985 Kashiwaya et al. ..... 123/492
4,561,404 12/1985 Kanno et al. ..... 123/492

FOREIGN PATENT DOCUMENTS 0005524 1/1982 Japan .

*Primary Examiner*—Willis R. Wolfe, Jr.
*Attorney, Agent, or Firm*—Lowe, Price, Leblanc, Becker & Shur

[57] ABSTRACT

An apparatus for use in an internal combustion engine including a single fuel injector provided for supplying fuel to an internal combustion engine upstream of an intake manifold connected to a plurality of cylinders. The apparatus includes a control circuit for provide a commend to cause the fuel injector to inject supplemental fuel to the engine in response to a demand for engine acceleration in order to provide a good acceleration performance. The amount of the supplemental fuel supplied to the engine is decreased in a manner to avoid creation of an overrich mixture in the cylinders when a demand for engine acceleration occurs again in a short time after the throttle valve closes to an angle less than a predetermined value.

13 Claims, 4 Drawing Figures

FUEL CONTROL APPARATUS FOR INTERNAL COMBUSTION ENGINE

BACKGROUND OF THE INVENTION

This invention relates to an apparatus for controlling the amount of fuel supplied to the engine upstream of its intake manifold connected to a plurality of cylinders with supplemental fuel during a demand for engine acceleration.

It is the current practice to provide a good engine acceleration performance by supplying supplemental fuel to the engine in response to a demand for engine acceleration. However, this practice cannot be applied directly to internal combustion engines of the single point injection (SPI) type having a single fuel injector provided for supplying fuel into the engine upstream of its intake manifold connected to a plurality of cylinders without a serious problem resulting from the fact that a great amount of fuel is collected on the inner wall of the intake manifold during wide-open throttle conditions. If engine acceleration is demanded again in a short time after a wide-open throttle condition continues for a long time, the collected fuel will be drawn into the cylinders to create an overrich mixture in the cylinders, causing increased HC and CO emissions.

SUMMARY OF THE INVENTION

There is provided, in accordance with the invention, an apparatus for use with an internal combustion engine including a throttle valve situated in an induction passage connected through an intake manifold to a plurality of cylinders. The apparatus comprises means for controlling the amount of fuel supplied to the engine at a position upstream of the intake manifold, sensor means sensitive to a condition of the engine for producing a sensor signal indicative of the engine condition, and a control circuit responsive to the sensor signal for determining a value corresponding to a setting of the means for controlling the amount of fuel to the engine. The control circuit includes means for determining a first value corresponding to the amount of fuel supplied to the engine based upon engine load and speed, means responsive to a demand for engine acceleration for determining a second value corresponding to the amount of supplemental fuel supplied to the engine, means for measuring a first time period during which the throttle valve remains at angles greater than a predetermined value, means for measuring a second time period after the throttle valve closes to the predetermined angle until a demand for engine acceleration occurs again, means for decreasing the second value when the first time period is greater than a predetermined value and the second time period is less than a predetermined value, and means for summing the first and second values to calculate the value corresponding to a setting of the means for controlling the amount of fuel to the engine. The apparatus also includes means for converting the calculated value into a setting of the means for controlling the amount of fuel to the engine.

Therefore, the invention provides an improved fuel control apparatus which is free from an overrich mixture causing increased HC and CO emissions when a demand for engine acceleration occurs again in a short time.

BRIEF DESCRIPTION OF THE DRAWINGS

The present invention will be described in greater detail by reference to the following description taken in connection with the accompanying drawings, in which.

DETAILED DESCRIPTION OF THE INVENTION

Figure 1:
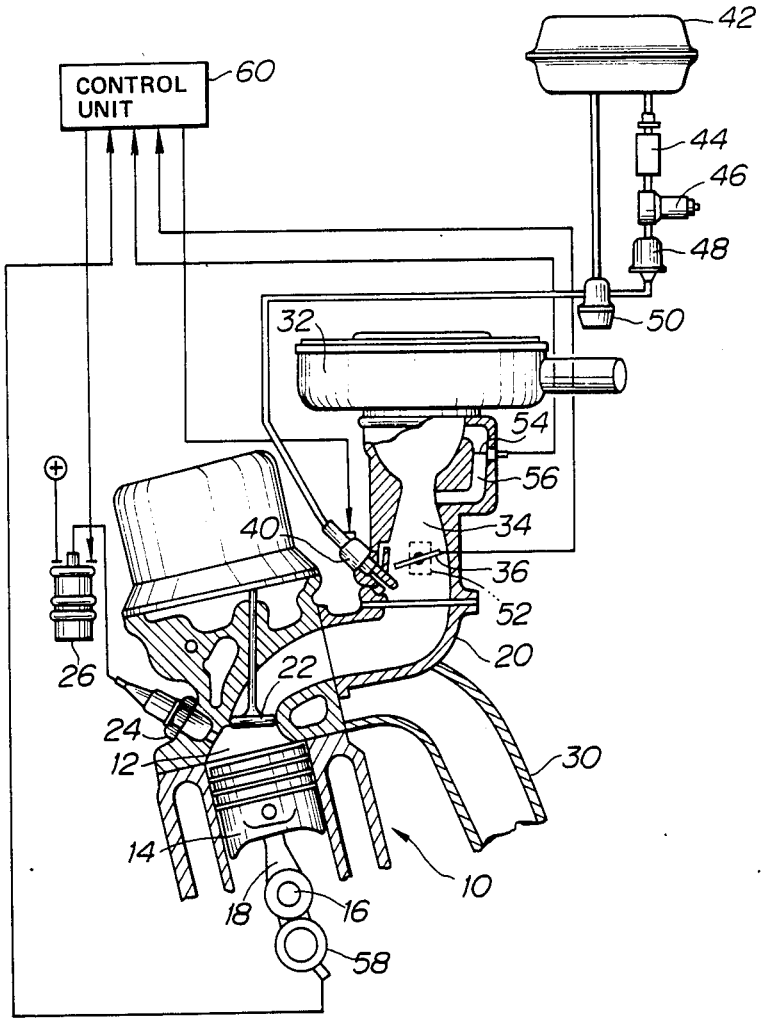
FIG. 1 is a schematic view showing one embodiment of a fuel control apparatus made in accordance with the invention.

With reference to the drawings, and in particular to FIG. 1, there is shown a schematic diagram of an engine control system embodying the apparatus of the invention. An internal combustion engine, generally designated by the numeral 10, for an automotive vehicle includes a combustion chamber or cylinder 12. A piston 14 is mounted for reciprocal motion within the cylinder 12. A crankshaft 16 is supported for rotation within the engine 10. Pivotally connected to the piston 14 and the crankshaft 16 is a connecting rod 18 used to produce rotation of the crankshaft 16 in response to reciprocation of the piston 14 within the cylinder 12.

An intake manifold 20 is connected with the cylinder 12 through an intake port with which an intake valve 22 is in cooperation for regulating the entry of combustion ingredients into the cylinder 12 from the intake manifold 20. A spark plug 24 is mounted in the top of the cylinder 12 for igniting the combustion ingredients within the cylinder 12 when the spark plug 24 is energized by the presence of high voltage electrical energy from an ignition coil 26. An exhaust manifold 30 is connected with the cylinder 12 through an exhaust port with which an exhaust valve is in cooperation for regulating the exit of combustion products, exhaust gases, from the cylinder 12 into the exhaust manifold 22. The intake and exhaust valves are driven through a suitable linkage with the crankshaft 16.

Air to the engine 10 is supplied through an air cleaner 32 into an induction passage 34. The amount of air permitted to enter the combustion chamber through the intake manifold 20 is controlled by a butterfly throttle valve 36 situated within the induction passage 34. The throttle valve 36 is connected by a mechanical linkage to an accelerator pedal. The degree of rotation of the throttle valve 36 is manually controlled by the operator of the engine control system.

A fuel injector 40 is connected to a fuel supply system which includes a fuel tank 42, a fuel pump 44, a fuel damper 46, fuel filter 48, and a pressure regulator 50. The fuel pump 44 is electrically operated and is capable of maintaining sufficient pressure. The fuel damper 46 attenuates the fuel pressure to an extent. The fuel filter 48 prevents any contaminants from reaching the fuel injector 40. The pressure regulator 50 maintain the pressure differential across the fuel injector 40 at a constant level. This regulation is accomplished by a variation in the amount of excess fuel returned by the regulator 50 to the fuel tank 42. The fuel injector 40 opens to inject fuel into the induction passage 34 upstream or downstream of the throttle valve 36 when it is energized by the presence of electrical current. The length of the electrical pulse, that is, the pulse-width, applied to the fuel injector 40 determines the length of time the fuel injector opens and, thus, determines the amount of fuel injected into the induction passage 34.

In the operation of the engine 10, fuel is injected through the fuel injector 40 into the induction passage 34 and mixes with the air therein. When the intake valve opens, the air-fuel mixture enters the combustion chamber 12. An upward stroke of the piston 14 compresses the air-fuel mixture, which is then ignited by a spark produced by the spark plug 24 in the combustion chamber 12. Combustion of the air-fuel mixture in the combustion chamber 12 takes place, releasing heat energy, which is converted into mechanical energy upon the power stroke of the piston 14. At or near the end of the power stroke, the exhaust valve opens and the exhaust gases are discharged into the exhaust manifold 30.

Although the engine 10 as illustrated in FIG. 1 shows only one combustion chamber 12 formed by a cylinder and piston, it should be understood that the engine control system described herein is designated for use on a multi-cylinder engine. Thus, it should be understood that there are a plurality of cylinders, and also intake valves, exhaust valves, reciprocating pistons and spark plugs related to the number of cylinders in the engine 10. Only one fuel injector is required for multi-cylinder applications since the engine control system shown is of the single point injection (SPI) type.

The amount of fuel metered to the engine, this being determined by the width of the electrical pulses applied to the fuel injector 40, the fuel-injection timing, and the ignition-system spark timing are repetitively determined from calculations performed by a digital computer, these calculations being based upon various conditions of the engine that are sensed during its operation. These sensed conditions include throttle position, intake air flow, and engine speed. Thus, a throttle position sensor 52, a flow meter 54, and an engine speed sensor 58 are connected to a control unit 60.

The throttle position sensor 52 preferably is a potentiometer electrically connected in a voltage divider circuit for supplying a DC voltage proportional to throttle valve position. The flow meter 54 comprises a thermosensitive wire placed in a bypass passage 56 provided for the induction passage 34 upstream of the throttle valve 36. The engine speed sensor 58 is associated with the engine crankshaft 16 and is capable of producing a signal corresponding to the speed of rotating of the engine crankshaft.

The control unit 60 controls the amount of supplemental fuel supplied through the fuel injector 40 in a manner to decrease it when a demand occurs for engine acceleration again in a short time. In greater detail, the control unit 60 determines a first value corresponding to the amount of fuel supplied to the engine based upon engine load and speed, determines a second value corresponding to the amount of supplemental fuel supplied to the engine in response to a demand for engine acceleration, measures a first time period during which the throttle valve 36 remains at angles greater than a predetermined value, measures a second time period after the throttle valve 36 closes to the predetermined angle until a demand for engine acceleration occurs again, decreases the second value when the first time period is greater than a predetermined value and the second time period is less than a predetermined value, sums the first and second values to calculate a value for fuel delivery requirement, and converts the calculated value to a setting of the fuel injector 40.

The control unit 60 may comprise a digital computer which includes a central processing unit (CPU), a random access memory (RAM), a read only memory (ROM), an input/output control circuit, and first and second counters. The central processing unit communicates with the rest of the computer via data bus. The input/output control circuit includes an analog-to-digital converter, counters and a fuel injection control circuit. The analog-to-digital converter receives analog signals from the flow meter 54 and the throttle position sensor 52 and it converts the received signals in digital form for application to the central processing unit. The A to D conversion process is initiated on command from the central processing unit which selects the input channel to be converted. The read only memory contains the program for operating the central processing unit and further contains appropriate data in look-up tables used in calculating appropriate values for fuel delivery requirements. The first counter is used in measuring the first time period and the second counter is used in measuring the second time period. Control words specifying desired fuel delivery requirements are periodically transferred by the central processing unit to the fuel injection control circuit which converts it into a fuel injection pulse signal for application to operate the fuel injector 40.

Figure 2:
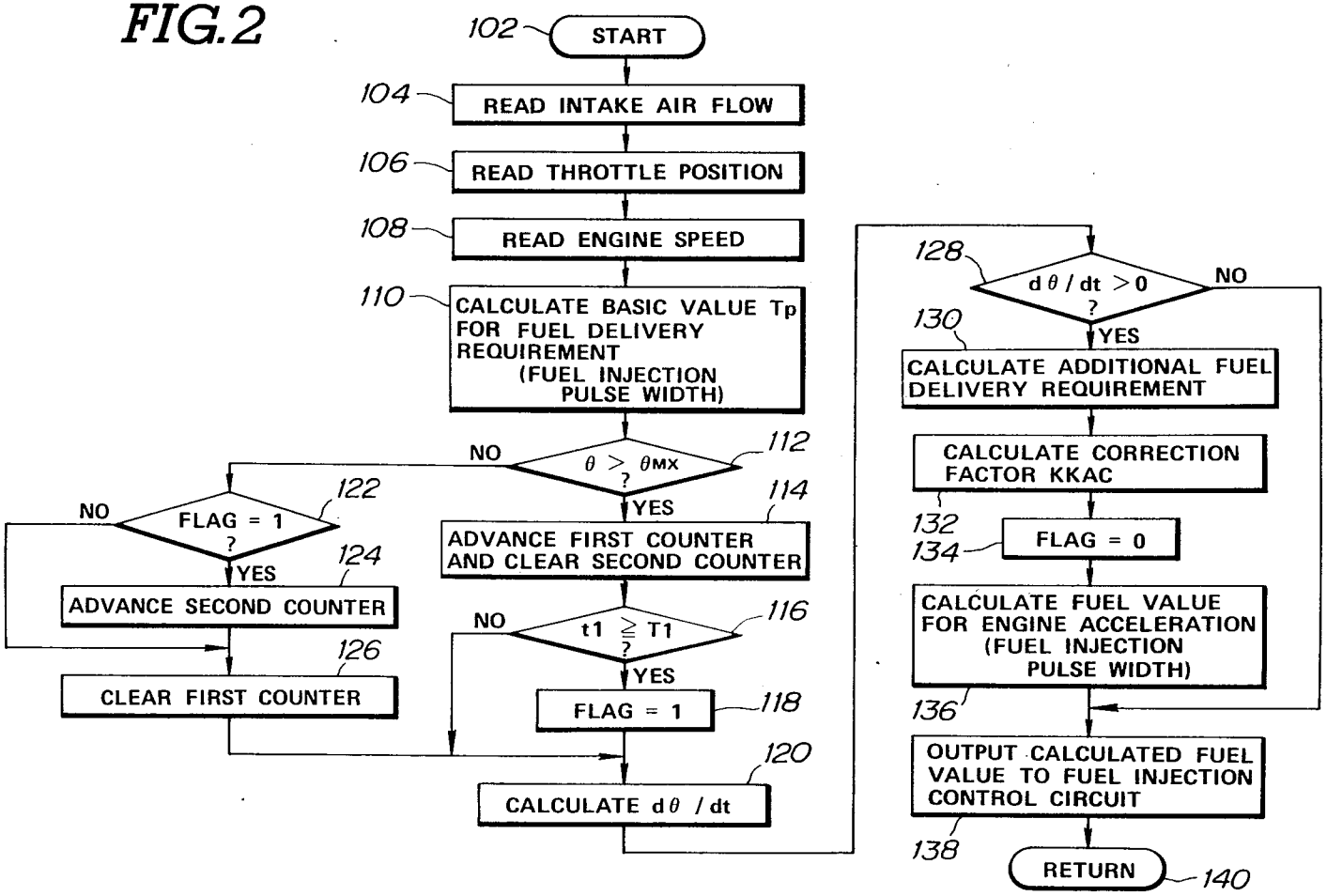
FIG. 2 is a flow diagram illustrating the programming of the digital computer employed in the control unit.

FIG. 2 is a flow diagram illustrating the programming of the digital computer as it is used to determine a desired value for fuel delivery requirement.

The computer program is entered at the step 102. At the step 104 in the program, the intake air flow signal fed from the flow meter 54 is converted to digital form and read into the computer memory. Similarly, at the step 106, the throttle position signal fed from the throttle position sensor 52 is converted to digital form and read into the computer memory. At the step 108 in the program, the engine speed signal fed from the engine speed sensor 58 is read into the computer memory. At the step 110, a basic value $T_p$ for fuel delivery requirement, in the form of fuel-injection pulse-width, is calculated by the digital computer central processing unit from a relationship programmed into the computer. The relationship defines fuel-injection pulse-width basic value $T_p$ as a function of intake air flow Q and engine speed N in a manner well known in the art.

At the step 112 in the program, a determination is made as to whether or not the read value $\theta$ for throttle-valve position is greater than a reference value $\theta_{MX}$. If the answer to this question is "yes", then the program proceeds to the step 114 where the central processing unit provides a command to cause the first counter to count up by one step and also a command to clear the second counter. The first counter accumulates a count t1 which indicates the time lapse after the read value $\theta$ exceeds the reference value $\theta_{MX}$ until the read value $\theta$ decreases below the reference value. Following this, the program proceeds to the step 116 where a determination is made. This determination is as to whether or not the count t1 of the first counter is equal to or greater than a predetermined value T1. If the answer to this question is "yes", then the program proceeds to the step 118 where a flag is set to indicate that the read value $\theta$ remains above the reference value $\theta_{MX}$ for a time period greater than the predetermined value T1 and then to the step 120 where the rate ($d\theta/dt$) of change of the throttle-valve position $\theta$ is calculated. Otherwise, the program jumps the step 118 and proceeds from the step 116 to the step 120.

If the answer to the question inputted at the step 112 is "no", then the program proceeds to the step 122 where a determination is made. This determination is as to whether or not the flag is set. If the answer to this question is "yes", then the program proceeds to the step 124 where the central processing unit provides a command to cause the second counter to count up by one step. The second counter operates only when the read value $\theta$ remains greater than the reference value $\theta_{MX}$ for a time period greater than the predetermined value T1 and accumulate a count t2 which indicates the time lapse after the read value $\theta$ decreases below the reference value $\theta_{MX}$ until acceleration is again resumed and then to the tep 126 where the first counter is cleared. Following this, the program proceeds to the step 120.

At the step 128 in the program, a determination is made as to whether or not the calculated value $d\theta/dt$ is positive. If the answer to this question is "yes", then it means that a demand occurs for engine acceleration and the program is proceeds to calculate a desired value for fuel delivery requirement for engine acceleration. At the step 130 in the program, the central processing unit calculates a value $K(\theta)$ for supplemental fuel delivery requirement in accordance with the calculated value $d\theta/dt$. At the step 132 in the program, the central processing unit calculates a correction factor KKAC from a relationship programmed into the computer. The relationship, shown in FIG. 3, defines the correction factor KKAC as a function of the count t2 of the second counter.

Figure 3:
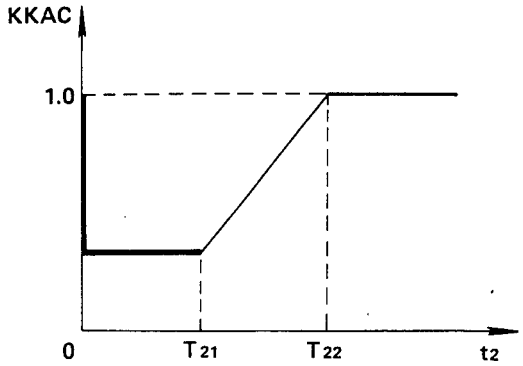
FIG. 3 is a graph of correction factor versus second time period used in determining the amount of supplemental fuel supplied to the engine.

As can be seen from FIG. 3, the correction factor KKAC is 1.0 if $t2=0$, and a constant value of about 0.3 if $0<t2<T21$. The correction factor KKAC increases in a linear fashion with increase in the count t2 of the second counter if $T21<t2<T22$ and remains at 1.0 if $t2<T22$. The character T21 indicates a first predetermined value and T22 indicates a second predetermined value greater than the first predetermined value T21.

At the step 134 in the program, the flag is cleared. Following this, the program proceeds to the step 136 where the central processing unit calculates a value for fuel delivery requirement for a demand for engine acceleration as $Ti=Tp+K(\theta)\times KKAC$. At the step 138 in the program, the calculated fuel value Ti is outputted to the fuel injection control circuit and the program proceeds to the step 140 where the computer program returns to the step 104. If the answer to the question inputted at the step 128 is "no", then the program proceeds directly to the step 138 where the fuel value Tp calculated at the step 110 is outputted as it is to the fuel injection control circuit.

The fuel injection control circuit converts the outputted value into a fuel-injection pulse-width which determines the length of time fuel is injected through the fuel injector 40 and thus the amount of fuel supplied to the engine.

The operation of the fuel control apparatus of the invention will be described with reference to the time chart of FIG. 4.

Assuming now that the first counter count t1 is zero and the second counter count t2 is zero at a time when a demand for engine acceleration occurs. At the time, the control circuit calculates a first value corresponding to a basic value for the amount of fuel supplied to the engine based upon engine load and speed and calculates a second value corresponding to the amount of supplemental fuel based upon the rate of change of the throttle valve position. Since the second counter count t2 is zero and thus the correction factor KKAC is 1, the second value is added as it is to the first value. As a result, the fuel injector 40 supplies fuel in an amount sufficient to provide a good acceleration performance according to the rate of change of the the throttle valve position.

When the throttle valve opens to the reference position $\theta_{MX}$, the control circuit causes the first counter to start counting up. This first counter counting operation continues until the throttle valve closes to the reference position $\theta_{MX}$. If the count t1 accumulated on the first counter is equal to or greater than a predetermined value T1, the control circuit causes the second counter to start counting up when the throttle valve closes to the reference position $\theta_{MX}$. This second counter counting operation continues until another demand occurs for engine acceleration.

Figure 4:
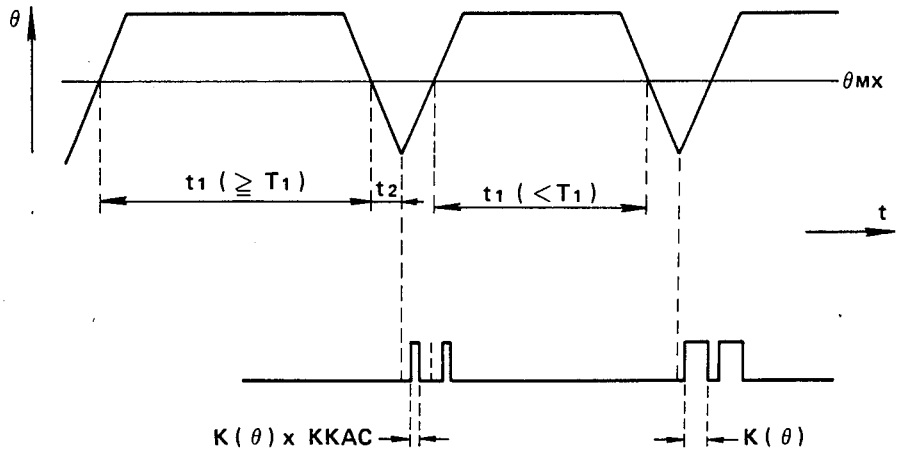
FIG. 4 is a time chart used in explaining the operation of the fuel control apparatus of the invention.

When the next demand occurs for engine acceleration, as indicated by the numeral 1 of FIG. 4, the control circuit calculates a second value corresponding to the amount of supplemental fuel supplied to the engine. If the count t2 accumulated on the second counter is less than the first predetermined value T21, the correction factor KKAC is set at a small value (about 0.3), as shown in FIG. 3, in order to reduce the second value corresponding to the amount of supplemental fuel supplied to the engine. This is effective to avoid creation of an overrich mixture in the cylinders resulting from the fact that a great amount of fuel is collected on the inner wall of the intake manifold and it is drawn into the cylinders during the opening movement of the throttle valve if the next acceleration occurs in a short time. If the second counter count t2 is greater than the first predetermined value T21 and less than the second predetermined value T22, the correction factor KKAC increases with increase in the second counter count t2, as shown in FIG. 3. The reason for this is that the fuel collected on the inner wall of the intake manifold has been drawn into the cylinders to a greater extent as the second counter count t2 increases. If the second counter count t2 is greater than the second predetermined value T22, the correction factor KKAC is set at 1.0, as shown in FIG. 3, to remain the second value as it is in order to provide a sufficient engine acceleration performance. The reason for this is that almost no fuel remains on the inner wall of the intake manifold.

When the first counter count t1 is less than the predetermined time T1, the second counter does not start counting up. Consequently, the second counter count t2 is zero and the correction factor KKAC is 1.0 when the next demand occurs for engine acceleration, as indicated by the numeral 2 of FIG. 4. Under this condition, the second value is added as it is to the first value. As a result, the fuel injector 40 supplies fuel in an amount sufficient to provide a good acceleration performance according to the rate of change of the throttle valve position. The reason for this is that the amount of fuel corrected on the inner wall of the intake manifold is small when the first time period is short.

According to the invention, the amount of supplemental fuel supplied to the engine is decreased when a demand occurs again for engine acceleration in a short time after a wide-open throttle condition. This is effective to avoid creation of an overrich mixture in the cylinders causing increased HC and CO emissions even though a successive demand occurs for engine acceleration in a short time.

What is claimed is:

1. An apparatus for use with an internal combustion engine including a throttle valve situated in an induction passage connected through an intake manifold to a plurality of cylinders, comprising:

means for controlling the amount of fuel supplied to said engine at a position upstream of said intake manifold;

sensor means sensitive to a condition of said engine for producing a sensor signal indicative of said engine condition;

a control circuit responsive to said sensor signal for determining a value corresponding to a setting of said means for controlling the amount of fuel to said engine, said control circuit including means for determining a first value corresponding to the amount of fuel supplied to said engine based upon engine load and speed, means responsive to a demand for engine acceleration for determining a second value corresponding to the amount of supplemental fuel supplied to said engine, means for measuring a first time period during which said throttle valve remains at angles greater than a predetermined value, means for measuring a second time period after said throttle valve closes to said predetermined angle until a demand for engine acceleration occurs again, means for decreasing said second value when said first time period (T1) is greater than a predetermined value (T1) and said second time period is less than a predetermined value, and means for summing said first and second values to calculate said value corresponding to a setting of said means for controlling the amount of fuel to said engine; and means for converting said calculated value into a setting of said means for controlling the amount of fuel to said engine.

2. The apparatus as claimed in claim 1, wherein said means for controlling the amount of fuel supplied to said engine comprises a single fuel injector provided to supply fuel to the engine upstream of said intake manifold.

3. The apparatus as claimed in claim 1, wherein said control circuit includes a throttle position sensor sensitive to a throttle-valve position for producing a signal indicative of said throttle-valve position.

4. The apparatus as claimed in claim 3, wherein said means for measuring a first time period includes means coupled to said throttle position sensor for measuring said first time period between the time at which said throttle-valve position indicative signal exceeds a predetermined value and the time at which said throttle-valve position indicative signal decreases to said predetermined time.

5. The apparatus as claimed in claim 4, wherein said means for determining a second value corresponding to the amount of supplemental fuel supplied to said engine includes means for calculating a rate of change of said throttle-valve position indicative signal, means for calculating said second value as a function of said calculated rate of change of said throttle-valve position indicative signal.

6. The apparatus as claimed in claim 5, wherein said means for measuring a second time period includes means for measuring said second time period between the time at which said throttle-valve position indicative signal decreases to said predetermined value and the time at which said calculated rate of change of said throttle-valve position indicative signal becomes positive.

7. The apparatus as claimed in claim 1 wherein said means for decreasing said second value includes means for determining a correction factor (KKAC) which is less than 1 when said second time period is less than said first predetermined value, and means for multiplying said correction factor by said second value.

8. The apparatus as claimed in claim 7 wherein said correction factor is determined as a function of said second time period.

9. The apparatus as claimed in claim 8 wherein said correction factor is 1 when said second time period is zero, a fixed value when said second time period is less than a second predetermined value less than said first predetermined time, said correction factor increasing with increase in said second time period when said second time period is greater than said second predetermined time and less than said first predetermined time and remaining at 1 when said second time period is greater than said first predetermined value.

10. An apparatus for use in an internal combustion engine including a throttle valve situated in an induction passage connected through an intake manifold to a plurality of cylinders, comprising:

means for controlling the amount of fuel supplied to said engine at a position upstream of said intake manifold;

a load sensor sensitive to an engine load for producing a signal indicative of said engine load;

a speed sensor sensitive to an engine speed for producing a signal indicative of said engine speed;

a throttle position sensor sensitive to a throttle-valve position for producing a signal indicative of said throttle position;

a control circuit including means responsive to said load and speed sensors for determining a first value corresponding to the amount of fuel supplied to said engine, means responsive to said throttle position sensor for measuring a first time period during which said throttle valve indicative signal remains greater than a predetermined value, means for providing a first signal when said first time period is greater than a predetermined value, means for calculating the rate of change of said throttle position indicative signal, means for providing a second signal when said calculated rate is positive, means operable in the presence of said first signal for measuring a second time period starting when said throttle position indicative signal decreases below said predetermined value and terminating when said calculated rate becomes positive again, means responsive to said second signal for determining a second value corresponding to the amount of supplemental fuel supplied to said engine based upon said calculated rate, means for decreasing said second value when said second time period is less than a first predetermined value, and means for summing said first and second values to calculate a value correspoonding to a setting of said means for controlling the amount of fuel supplied to said engine; and means for converting said calculated value into a setting of said means for controlling the amount of fuel to said engine.

11. The apparatus as claimed in claim 10 wherein said means for decreasing said second value includes means for determining a correction factor (KKAC) which is less than 1 when said second time period is less than said first predetermined value, and means for multiplying said correction factor by said second value.

12. The apparatus as claimed in claim 11 wherein said correction factor is determined as a function of said second time period.

13. The apparatus as claimed in claim 12 wherein said correction factor is 1 when said second time period is zero, a fixed value when said second time period is less than a second predetermined value less than said first predetermined time, said correction factor increasing with increase in said second time period when said second time period is greater than said second predetermined time and less than said first predetermined time and remaining at 1 when said second time period is greater than said first predetermined value.

* * * * *